US007732048B2

(12) United States Patent
Kwon et al.

(10) Patent No.: US 7,732,048 B2
(45) **Date of Patent: *Jun. 8, 2010**

(54) CELLULOSE MULTI-FILAMENT

(75) Inventors: Ik-Hyun Kwon, Kyonggi-do (KR); Soo-Myung Choi, Kyonggi-do (KR); Tae-Jung Lee, Kyonggi-do (KR); Jae-Shik Choi, Kyonggi-do (KR)

(73) Assignee: Hyosung Corporation, Kyonggi-do (KR)

( * ) Notice: Subject to any disclaimer, the term of this patent is extended or adjusted under 35 U.S.C. 154(b) by 280 days.

This patent is subject to a terminal disclaimer.

(21) Appl. No.: 11/886,298

(22) PCT Filed: Sep. 23, 2005

(86) PCT No.: PCT/KR2005/003157

§ 371 (c)(1),
(2), (4) Date: Sep. 14, 2007

(87) PCT Pub. No.: WO2006/098542

PCT Pub. Date: Sep. 21, 2006

(65) Prior Publication Data

US 2009/0011234 A1 Jan. 8, 2009

(30) Foreign Application Priority Data

Mar. 15, 2005 (KR) ..... 10-2005-0021205

(51) Int. Cl.
*B32B 23/00* (2006.01)

(52) U.S. Cl. ..... 428/393; 152/451

(58) Field of Classification Search ..... 428/393, 428/364; 152/451, 527

See application file for complete search history.

(56) References Cited

U.S. PATENT DOCUMENTS 4,246,221 A 1/1981 McCorsley, III
5,252,284 A 10/1993 Jurkovic et al.

(Continued)

FOREIGN PATENT DOCUMENTS

EP 0 356 419 A2 2/1990

(Continued)

OTHER PUBLICATIONS

International Search Report for International Application No. PCT/KR2005/003157 mailed Dec. 15, 2005.

*Primary Examiner*—N. Edwards
(74) *Attorney, Agent, or Firm*—Nixon & Vanderhye P.C.

(57) ABSTRACT

The present invention relates to cellulose fiber containing 500 to 2000 of filaments and having homogeneous physical properties and the multi-filaments according to the present invention is characterized in that the strength and the breaking elongation of the multi-filaments are 4 to 9 g/d and 4 to 15%, respectively. In particular, the present invention is characterized in that each mono-filament selected 100 strands from every three part divided from multi-filaments has properties as following: (a) 3 to 9 g/d in average strength, 7 to 15% in average breaking elongation and 0.035 to 0.055 in by birefringence, (b) the differences of the above three parts are below 1.0 g/d in average strength, 1.5% in breaking elongation and 0.7 denier in denier, (c) the CV (%) (coefficient of variation) of the above three parts are below 10%, and (d) the birefringence differences of the above three parts are below 0.004.

2 Claims, 1 Drawing Sheet

U.S. PATENT DOCUMENTS

| | | | | |
|---|---|---|---|---|
| 5,584,919 | A | 12/1996 | Lee et al. | |
| 5,725,821 | A | 3/1998 | Gannon et al. | |
| 5,942,327 | A | 8/1999 | Budgell et al. | |
| 6,153,003 | A | 11/2000 | Lee et al. | |
| 6,241,927 | B1 | 6/2001 | Mulleder et al. | |
| 6,852,413 | B2 * | 2/2005 | Lee et al. | 428/393 |
| 6,983,779 | B2 | 1/2006 | Kwon et al. | |
| 2005/0079348 | A1 | 4/2005 | Lee et al. | |
| 2006/0099416 | A1 * | 5/2006 | Kwon et al. | 428/364 |
| 2006/0099419 | A1 * | 5/2006 | Kwon et al. | 428/375 |
| 2007/0241477 | A1 * | 10/2007 | Kwon et al. | 264/203 |
| 2009/0011234 | A1 * | 1/2009 | Kwon et al. | 428/378 |

FOREIGN PATENT DOCUMENTS

| | | | |
|---|---|---|---|
| EP | 1 433 881 | A2 | 6/2004 |
| EP | 1 493 752 | A1 | 1/2005 |

* cited by examiner

CELLULOSE MULTI-FILAMENT

This application is the U.S. national phase of International Application No. PCT/KR2005/003157, filed 23 Sep. 2005, which designated the U.S. and claims priority to KR 10-2005-0021205, filed 15 Mar. 2005, the entire contents of each of which are hereby incorporated by reference.

TECHNICAL FIELD

The present invention relates a cellulose multi-filament having homogeneous physical property, in particular cellulose a multi-filament for using as industrial materials, preferably tire-cord produced as following steps: preparing a homogeneous cellulose solution by swelling a cellulose powder with a concentrated liquid N-methyl morpholine N-oxide (NMMO); extruded-spinning the cellulose solution through an air gap using a spinning nozzle with 500 to 2000 of orifices and then obtaining a multi-filaments after solidifying the spun cellulose solution; and winding the multi-filaments after water-washing, drying and treating with a finishing oil.

And the present invention relates to a cellulose fiber having 500 to 2000 filaments, and the filaments are characterized in that the strength of each of multi-filaments is 4 to 9 g/d, the breaking elongation is 4 to 15%, the specific breaking time is 3 to 33 sec/denier and the multi-filaments have homogeneous physical properties on the whole. More specifically, the present invention relates to the cellulose multi-filament for use of industrial materials, wherein each of 100 mono-filaments selected from each of three parts divided from the multi-filaments has properties as following; a) 3 to 9 g/d in average strength, 7 to 15% in average breaking elongation, and 0.035 to 0.055 in average birefringence, b) the differences of three parts in average strength, breaking elongation and denier are below 1.0 g/d, 1.5% and 0.7 denier, respectively, c) CV (coefficient of variation)(%) of three parts in average strength, breaking elongation and denier is below 10%, and d) the differences of the average birefringence of three parts are below 0.004.

BACKGROUND ART

A cellulose fiber manufactured with a cellulose and NMMO is utilized in various fields needing the cellulose fiber in the process of manufacturing, because all the solvent used in the process of manufacture of the cellulose fiber is recycled and therefore the manufacture of the cellulose fiber corresponds to a non-pollution process, and the produced fiber has high mechanical strength, and referring to EPO no. 0356419, a cellulose solution produced using amine oxide together with NMMO is described, and U.S. Pat. No. 4,246,221 discloses a method for producing a cellulose solution with a tertiary amine oxide, and according to the above U.S. Pat. No. 4,246,221 the cellulose solution is spun using a device for forming such as a spinneret into filaments and then the filaments are precipitated in a bath to pass a coagulating bath and finally the swollen cellulose containing water is produced. But the above method takes a long time from dissolving to spinning process, and the degradation of physical properties results from heat-decomposition owing the long time process. And also the expense of energy is so much that the large costs for manufacturing are non-avoidable.

On the other hand, H. Chanzy et al. (Polymer Vol 31 pp 400~405, 1990) produced a cellulose fiber with 56.7 cN/tex of strength and 4% of breaking elongation in a manner that DP 5,000 cellulose was dissolved into NMMO to prepare a cellulose solution, and ammonium chloride or calcium chloride was added to the cellulose solution, and then the resultant was spun through an air gap, but the method for producing the cellulose fiber has difficulty with being available commercially because the number of filaments is only 1 strand and the fibril orientated in direction of axis is exfoliated.

Referring to other prior invention, U.S. Pat. No. 5,942,327 describes a cellulose fiber having 50 to 80 cN/tex (5.7 to 9.1 g/d) strength, 6 to 25% elongation and 1.5 dtex mono strand fineness and produced in a manner that an aqueous NMMO solution into which DP 1,360 cellulose is dissolved is spun through an air gap, but the number of filaments is only 50 strands. The cellulose fiber produced in the above manner has difficulty with being available commercially, considering that generally the number of filaments for using as industrial materials should be about 1000 strands (1,500 denier) because (a) the efficient removal of solvent is necessary in view of process and (b) the capacity of inner skin is enough maximized to resist the repeated fatigue in view of physical property.

In general when a spinning process is performed, in view of technology, spinning with 500 to 2,000 orifices per spinning nozzle is more difficult than spinning with 50 orifices per spinning nozzle. The reason is that the uniform adjustment of spinning pressure is more difficult in proportion to the increase of the number of orifices and thus it is difficult to design a spinning nozzle and a distributing plate, in particular to adjust the condition for cooling evenly in an air gap and for washing and drying homogeneously all the filaments of 500 to 2,000, and as result it is very difficult to make all the filaments posses physical properties above a certain level and the homogeneous physical properties, and therefore the physical properties of 50 strands according to U.S. Pat. No. 5,942,327 is not sufficient for reference to the application of industrial materials.

In particular, because the increase of the number of filaments affects the stability of process relating to adhesion to the filaments spun from the nozzle and the efficiency when a spinning is performed through an air gap, the number of holes in a distributing plate for dispersing evenly the cellulose solution on the nozzle, the space of the holes and the diameter of the holes as well as the outer diameter of the nozzle and the diameter and space of orifices are very important.

As described in the above, as the number of filaments increases a new design for spinning is necessary considering the length of air gap, the blowing condition of cooling air, the direction of the coagulating solution and the spinning speed, and the physical properties may be different according to the design.

U.S. Pat. No. 5,252,284 describes a cellulose fiber having 800 to 1,900 of filaments, however, it was found that when the filaments was spun under the condition of short air gap less than 10 mm and winding speed of 45 m/min the resultant had 15.4% elongation, sufficiently high, and the 47.8 cN/tex (5.3 g/d) strength, not sufficient for use of a industrial material, in particular tire-cord. And the cellulose has disadvantage that the physical properties of each filament are not homogeneous.

DISCLOSURE OF INVENTION

Technical Problem

The present invention provides a solution to the problems that the prior inventions mentioned above has, and in a preferred embodiment of the present invention, there is provided with a cellulose fiber having 500 to 2000 filaments, and characterized in that the strength of multi-filaments is 4 to 9 g/d, the breaking elongation is 4 to 15%, the specific breaking time is 3 to 33 sec/denier and the multi-filaments has homogeneous physical properties. More specifically, the present invention provides a cellulose multi-filaments for use of industrial materials, in which each 100 mono-filaments selected from each three parts divided from the multi-filaments have the properties as following; a) 3 to 9 g/d in average strength, 7 to 15% in average breaking elongation and 0.035 to 0.055 in average birefringence, b) the differences of three parts in average strength, breaking elongation and denier are below 1.0 g/d, 1.5% and 0.7 denier, respectively, c) CV (coefficient of variation)(%) of three parts in average strength, breaking elongation and denier is below 10%, and d) the differences of the average birefringence of three parts are below 0.004.

Technical Solution

There may be provided with a cellulose fiber for use of industrial materials, a method for producing the fiber comprising the steps of: (A) producing a cellulose solution by swelling and homogenizing a cellulose powder into an aqueous concentrated N-methyl morpholine N-oxide (NMMO) solution; (B) obtaining a multi-filaments by spinning the cellulose solution with a spinning nozzle having 500 to 2000 orifices and subsequently precipitating the cellulose solution into a coagulating bath through an air gap; and (C) water-washing, drying, treating with a finishing oil and winding the multi-filaments. And, furthermore, the cellulose fiber is characterized in having following physical properties; (1) 500 to 3000 in denier of the cellulose multi-filaments fineness; (2) 4 to 9 g/d in strength of the multi-filaments; (3) 4 to 15% in breaking elongation of the multi-filaments; (4) 3 to 33 sec/denier in specific breaking time; (5) the multi-filaments are divided into three parts and 100 mono-filaments selected from each part of the three parts has following physical properties; 3 to 9 g/d in average strength, 7 to 15% in breaking elongation and 0.035 and 0.055 birefringence, respectively; (6) the differences of average strength, average breaking elongation and average denier are less than 1.0 g/d, 1.5% and 0.7 denier, respectively; (7) CV (coefficient of variation) of average strength, average breaking elongation and denier of said three parts less than 10%; and (8) the differences of average birefringence of said three parts are less than 0.004.

According to one aspect of the present invention, the cellulose may comprise a distributing plate have 50 to 300 of holes within the nozzle.

According to other aspect of the present invention, the air gap may be in 5 to 30° C. temperature and in 10 to 60% relative humidity, and the cooling air may be supplied with 0.5 to 10 m/s velocity.

According to another aspect of the present invention, the temperature of the coagulation bath may be between 0 and 35° C.

According to a further aspect of the present invention, the temperature of the drying roller may be between 80 and 170° C.

According to a further aspect of the present invention, there may be provided with a tire-cord including the cellulose fiber of the present invention.

Advantageous Effects

The cellulose fiber according to the present invention consists of 500 to 2000 filaments, and is characterized in that the strength and breaking elongation of the filaments are 4 to 9 g/d and 4 to 15%, respectively and the physical properties are homogeneous. Therefore, the cellulose filaments can be used as industrial materials, in particular tire-cord requiring the high strength and homogeneous properties.

BEST MODE FOR CARRYING OUT THE INVENTION

Figure 1:
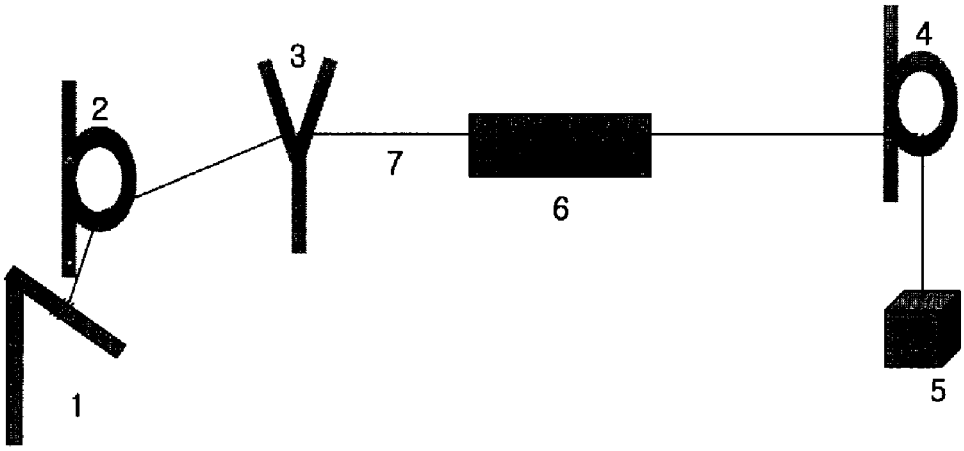
FIG. 1 shows a schematic view of the device to measure the specific breaking time for the homogenous cellulose multi-filaments according to the present invention.

In the following the present invention will be described in detail as examples using accompanied drawings. The following description is illustrative of embodiments of the present invention. The following description is not to be construed as limiting, it being understood that the skilled person may carry out many obvious variants to the invention.

The cellulose used in following examples may be pulverized to particles with a diameter no more than 500 μm, preferably 300 μm using a milling device with a knife bar and the cellulose may be V-81 available from Buckeye company, USA. If the diameter is more than 500 μm, then the dispersion and swelling is not performed constantly into a extruder.

Meanwhile, according to the present invention, in a known manner a NMMO solution with 50 wt % concentration is condensed to make a concentrated NMMO solution with 10 to 15 wt % moisture. In this case, if the contents of moisture are to be made below 10 wt %, then a disadvantage in view of manufacturing expense may be caused owing to the increase of cost, while the solubility may be degraded if above 15 wt %.

0.001 wt % to 0.01 wt % anti-oxidant may be added to the concentrated aqueous NMMO solution. And then the concentrated aqueous NMMO solution and the cellulose powder are continuously fed into an extruder at temperature of 65 to 110° C., to produce a homogeneous cellulose solution after mixing, swelling and dissolving. The contents of cellulose powder contained in the cellulose solution which is mixed, swollen and dissolved in the extruder is 3 to 20 wt %, and preferably 9 to 14 wt % compared to the aqueous NMMO depending on the polymerization degree of cellulose polymer. If the contents of cellulose powder are below 3 wt %, then there may not have the properties of fiber, while all the cellulose powder may not be dissolved into the aqueous NMMO solution resulting in non-homogeneous solution, if above 20 wt %.

The extruder which is used for producing the homogeneous cellulose solution in step (A) may be preferably a twin-screw extruder in which the twin-screw extruder preferably may have barrels of 8 to 14 and the length/diameter (L/D) of screws may be preferably 24 to 64. If the number of barrels is less than 8 or L/D of the screws is less than 24, then the time interval for which the cellulose solution passes the barrels is too short to swell and dissolve the cellulose powder and thus a certain cellulose powder may remain not being dissolved, while the expense for manufacturing the extruder may be high and also the pressure exerted on the extruder may be large if the number of barrels is more than 14 or L/D of the screws are more than 64.

In step (B), the cellulose powder may be used with other high molecular materials or additives mixed. The high molecular materials may include polyvinylalcohol, polyethylene, polyethylene glycol, polymethylmethacrylate and the like, and the additives may comprise viscosity-dropping agents, $TiO_2$, $SiO_2$, carbon, carbon nano-tube, inorganic clay and the like.

The method for producing a cellulose fiber will be described more specifically including the steps of spinning, water-washing, drying and winding in the following. But it should not be understood that the cellulose fiber claimed in the present invention will be limited to any of the above steps.

Referring to the step (B) corresponding to the process of spinning, a distributing plate having the diameter of 50 to 200 nm and holes of 50 to 300 serves the solution to be dispersed evenly on the nozzle. If the number of holes is less than 50, then the pressure of the cellulose solution may be concentrated on a part of the nozzle and thereby the mono denier of the filaments through the nozzle may be not constant, even to affect the property of spinning. On the other hand, if the number of holes is more than 300, the pressure on the nozzle may be made constant, but the slight difference from the pressure of the solution passing the nozzle may affect the property of spinning.

The spinning solution may be extruded-spun through orifices being installed on the nozzle and being 100 to 300 μm in diameter and 100 to 2400 μm in length wherein length/diameter (LfD) is 2 to 8 and the space between the orifices is 0.5 to 5.0 mm, and the spun solution is precipitated into a coagulating bath through an air gap to be made a multi-filaments after coagulation.

The form of the nozzle used for spinning is usually circular, and the diameter of nozzle maybe 50 to 200 mm, and preferably 80 to 150 mm. If the diameter of nozzle is less than 50 mm, then the short distance between the orifices may make the cooling efficiency be lowered resulting in adhesion of the spun solution before coagulation, while the device may be so large that it cause disadvantage in view of equipment if the diameter of nozzle is more than 200 mm. And also if the diameter of nozzle is less than 100 μm or more than 300 μm, then the nozzle may affect the spinning property with worse quality, for example, it happens to break strands down frequently. If the length of orifices is less than 100 μm, then the physical properties are poor because of the worse orientation of the solution, while if more than 2400 μm, then the cost and endeavor for manufacturing the orifices may be excessive.

Considering the cellulose of the present invention to be used for industrial materials, in particular for tire-cord, the number of the orifices may be 500 to 2000, and preferably 700 to 1500. Some development of cellulose fiber for use of industrial materials has been reported, but no development of cellulose fiber for use of high strength filaments such as tire-cord, for more is the number of spinning-filaments, more affected the spinning property is by the number of orifices and more excellent spinning technology is required.

The present invention used a spinning nozzle containing a proper number of orifices for solving the above problem as mentioned above. If the number of orifice is less than 500, then the fineness of each filament is thicker than required and thus the processes of coagulating and water-washing may be performed incompletely because the time interval to remove NMMO from filament is too short. On the other hand, if the number of orifices is more than 2000, then a filament may be easily stuck to adjacent filament during passing the air gap, and the stability of each filament may be degraded after spinning and thus the quality of physical property may be poor, subsequently to cause some problems in the processes of twisting and heat-treatment for application of tire-cord.

If the diameter of the spun filament is too large when the solution spun from the spinning nozzle is precipitated into the coagulating bath, then it is difficult to obtain a cellulose fiber formed closely and homogeneously owing to the difference of the coagulation speed between skin and core part of filament. Therefore, on spinning a cellulose solution spun through a suitable air gap length, even though the discharging quantity is same, may be precipitated into the coagulating solution keeping the diameter of filament finer. Too short length of the air gap may make it difficult to increase the spinning velocity because fast coagulation of filament-surface and diffusion of solvent increase fine pores, while too long length of the air gap make it difficult to keep process stability because the spinning solution is more subject to the adhesion of filament, ambient temperature and humidity compared to other cases.

The length of the air gap may be preferably 10 to 200 mm, and more preferably 20 to 100 mm. When the cellulose solution passes through the air gap, a cooling air is provided for avoiding adhesion among adjacent filaments and coagulating the filament, and for enhancing the resistance against penetrating into the coagulating solution. And a sensor may be installed between an opening of a cooling air supply and the filament to adjust temperature and humidity by monitoring the temperature and humidity. In general the temperature of the supplied air may be kept between 5 to 30° C. If the temperature is less than 5° C., then the expense for cooling is excess as well as high speed spinning is difficult because the coagulation of filament is accelerated, while if more than 30° C., then broken filaments may occur frequently owing to the degradation of the cooling effect for the discharged solution.

On the other hand the contents of the moisture within the air gap may be important factor to affect the process of coagulation, and therefore the relative humidity within the air gap should be properly between RH10% and RH60%. More specifically, for controlling the coagulation speed and preventing the adhesion on the surface of the nozzle, dried air of RH10% to 30% may be supplied in the area adjacent to the nozzle and wet air of RH30% to 50% may be supplied in area adjacent to the coagulating solution. The cooling air may be blown horizontally toward the side of the filaments discharged perpendicularly, and the air velocity is preferably 0.5 to 10 m/sec, and more preferably 1 to 7 m/s for stability. If the cooling air velocity is too slow, then other atmosphere conditions around the filaments spun to the air gap may not be avoidable and hence non-homogeneous filaments may be produced owing to the difference of the solidification speed and the broken strand wherein the difference may be caused by the latest arrival of the cooling air on the spinning nozzle, while if it is too fast, then the spinning stability may be impeded by the risk of the adhesion caused from the filaments swing and by the hindrance of the homogeneous flow.

According to the present invention, the concentration of the aqueous solution in the coagulating bath may be 5 to 40%. If the spinning speed is more than 50 m/min when the filaments pass the coagulating bath, then the fluctuation of the coagulating solution may be severe owing to the friction between the filaments and the coagulating solution. For obtaining excellent physical properties and enhancing the productivity with the increase of the spinning speed, the above phenomenon may harm the process stability, and therefore the occurrence of the above phenomenon has to be minimized through a coagulating bath design considering the shape and size of the bath, the flow and quantity of the coagulating solution.

In step (C) according to the present invention, the produced multi-filaments are directed toward a water-washing bath to wash. Because the remove of solvent and the construction of form that affect the formation of the physical properties are performed concurrently when the filaments pass into coagulation bath, the temperature and concentrate of the solution has to be kept constant. The temperature of the bath may be 0 to 35° C., and preferably 10 to 25° C. If the temperature is less than 0° C., then the filament may be washed incompletely, while if more than 35° C., then the NMMO contained within the filament will be extracted too fast to generate voids within the filament and thereby the degradation of physical properties may be caused. After coagulating, the filament is water-washed in a chamber about at 35° C. until NMMO is removed completely.

After water-washing, the multi-filaments are dried continuously using a drying roller which can adjust the temperature between 80 and 170° C., and preferably between 100 and 150. If the temperature is less than 80° C., then the filaments may be dried incompletely, while if more than 170° C., the filaments may be contracted suddenly and excessively to cause the degradation of the physical property. The dried filaments may be wound in a known manner after treating with organic solvent. The wound cellulose filaments may be used for filament raw yarns of a tire-cord and industrial material.

The multi-filaments according to the present invention are characterized in that the total range of denier is 500 to 3000 and the breaking load is 4.0 to 27.0 kg. The multi-filaments consist of a set of filaments in which each filament is 0.5 to 4.0 deniers and the total number of filaments is 700 to 2000. And also the multi-filaments are 4.0 to 9 g/d in strength, 4 to 15% in elongation and 3 to 33 sec/denier in specific breaking time with homogeneous physical property.

The cellulose fiber for use of industrial materials according to the present invention is characterized in that each monofilament of selected 100 strands from every three part divided from multi-filaments has properties as following: (a) 3 to 9 g/d in average strength, 7 to 15% in average breaking elongation and 0.035 to 0.055 in average birefringence, (b) the differences of the above three parts are below 1.0 g/d in average strength, 1.5% in breaking elongation and 0.7 denier in denier, (c) the CV (%)(coefficient of variation) of the above three parts are below 10%, and (d) the birefringence differences of the above three parts are below 0.004.

To produce the cellulose fiber for use of industrial materials to fulfill all the above physical properties, the factors of process mentioned foregoing are important. In particular, the determinant factors to form homogeneous physical properties of the cellulose fiber may be the number of orifices, the distributing plate, the cooling-level within the air gap, the temperature of coagulating bath and the temperature of drying roller. The proper adjustment of the above factors may lead to the cellulose fiber for use of industrial material according to the present invention.

In the following the cellulose fiber according to the present invention will be described in detail with examples and comparisons, but they are given to clearly understand, not to limit the present invention. In examples and comparisons, the properties of the cellulose are estimated as following.

(a) Degree of Polymerization ($DP_w$):

The intrinsic viscosity [IV] of the dissolved cellulose was measured using 0.5M cupriethylenediamine hydroxide solution obtained according to ASTM D539-51T in the range of 0.1 to 0.6 g/dl of concentration at 25±0.01 C with Ubelohde viscometer. The intrinsic viscosity was calculated from the specific viscosity using extrapolation method according to the concentration and then the value obtained in the above was substituted into Mark-Houwink s equation to obtain the degree of polymerization.

$$[IV]=0.98\times10^{-2}DP_w^{0.9}.$$

(b) Birefringence

Birefringence was measured with Berek compensator using a polarization microscope for which the light source is Na-D.

(c) Strength (g/d) and Breaking Elongation (%) of Multi-filaments

The above values were measured immediately after dried with a heat wind dryer for 2 hours at temperature of 107° C. The measurement was performed with a low-speed elongating tensile strength tester from Instrong LTD., USA and the conditions of measurement are as following:

80 Tpm(80 turns twist/m); 250 mm in length of sample; 300 m/mm at speed of elongation.

(d) Specific Breaking Time (sec/denier)

Specific breaking time may be estimated in a manner that high pressurized water is injected onto the surface of the filaments to cause fibril with an injector and then the elapsed time (seconds) to result to the breakage of the filament is divided by filament deniers to calculate specific breaking time. In general, the less is specific breaking time, the more easily do fibril happen, and hence the filament tends to break faster.

FIG. 1 shows a schematic structure of a device for measuring specific breaking time for the cellulose fiber according to the present invention.

For measuring specific breaking time of the filament, one end of the filament is tired and fixed at a clamp 1 and the other end of the filament is guided through a first guide 2. And then the other end of the filament is directed to a second guide 4 via a guide tube 7 of injector 6 injecting pressurized water on the surface of the filament, and then 0.25 g weight 5 per denier is suspended at the other end of the filament. The distance between the first guide 2 and the second guide 4 may be about 30 mm, and the material of each guide may be ceramic. And the distance between Y guide 3 and an opening of the injector 6 may be about 30 mm.

Figure 2:
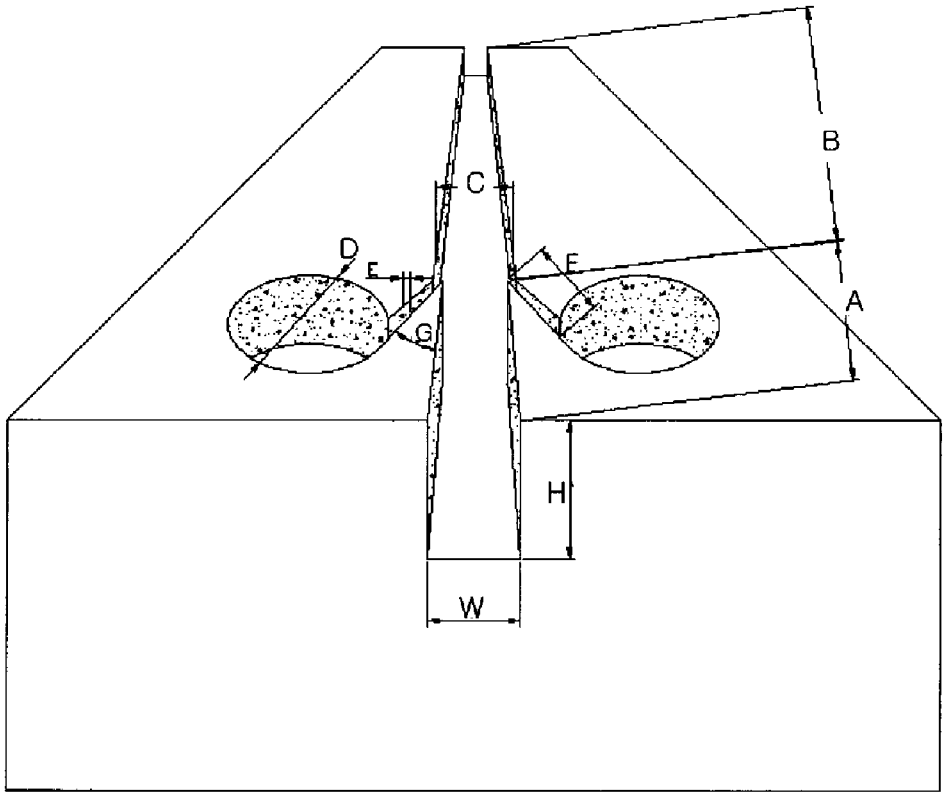
FIG. 2 shows a detailed view of the injector of the device.

FIG. 2 shows the injector for measuring specific breaking time of the cellulose fiber according to the present invention.

The injector may be made from stainless materials and have a rectangular shape of section with the following dimensions of width (W) and height (H):

W=H=the total deniers of multi-filaments/75 (mm).

A pair of injecting holes placed within the injector for injecting water may be faced each other, placed on the corresponding side walls and spaced 10 mm between them. And each hole may inject water of about 25° C. with angle of 15 degrees based on the axis of filament using supply guides. The amount of water (Q) injected on the filament may be estimated by the following equation and inject thought supply guides and a pair of holes:

$$Q=(\text{total deniers of filament}\times0.6\ \text{Liter})/\text{time}.$$

The diameter (E) of each supply guide may be about 0.6 mm and the height of each supply guide may be about 1 mm. And the length (F) of each supply guide may be about 6 mm and the width (C) between the hole and an outlet may be determined by the following equation:

$$C=W\times1.2\ (\text{mm}).$$

The distance between water injecting hole and the outlet is about 1.2 mm and the height is 1 mm.

Water is injected from below the injector 6 through the hole with about 4 mm diameter.

Even though the injector is not showed in FIG. 2, the injector is concealed with a cover which covers flat the upper part of the injector.

For measuring specific breaking time, the filament bundle is inserted into the injector in FIG. 1 and a weight is suspended. The measurement of specific breaking time is initiated at the time water is introduced into the injector and continues until the weigh falls down, that is, the measurement may be terminated at the moment the bundle tears.

The measurement may be repeated 10 times and specific breaking time for the filament may be estimated with the average value of 10 time measurements.

(e) Strength (g/d), Breaking Elongation (%) and CV (%) of Mono-filament

The multi-filaments were divided into three parts after keeping for 24 hours at temperature of 25° C. and at relative humidity of 65 RH % and then 100 strands of mono filament from each of the three parts were selected to measure denier and elongation-strength with Vibrozet 2000 from Lenzing LTD. Initial load of 200 mg was exerted on the mono-filament of 20 mm in length, and then the denier and elongation-strength was measured with 20 mm/min. The coefficient of variation (CV) was calculated after the average strength and breaking elongation was measured. CV indicates the degree of variation, and is calculated by dividing the standard deviation with the average value.

MODE FOR THE INVENTION

EXAMPLE 1

An aqueous concentrated NMMO solution was fed into a twin-screw extruder, which was kept at temperature of 78° C., at 6900 g/hour with a gear pump. And cellulose sheet (V-81 available from Buckeye LTD) with 1200 average degree of polymerization was put into a crusher with 250 μm filter to be made into powder being less than 200 μm in diameter and 5% in contents of moisture, and then the power was fed into the extruder at 1031 g/hour (concentration of 13 wt%) with a screw type supply.

The remaining time in swelling area was for 8 to 10 minutes in order to swell sufficiently the cellulose powder, and then the cellulose powder was dissolved completely under condition that each block temperature in the dissolving area of the extruder was at 90 to 95° C. and the screws operated at speed of 200 rpm. Subsequently the solution was discharged with a distributing plate having 100 holes through a nozzle in which the diameter of orifice was 150 μm, the space between orifices was 1.5 mm and the number of orifices was 800 (example 1-1), 1,100 (example 1-2) and 1,500 (example 1-3), respectively. The length of an air gap was 100 mm in which cooling air brown to the filaments within the air gap was under temperature of 20° C., 45 RH % of relative humidity and 6 m/mm of velocity.

The filaments precipitated into a coagulating bath (5° C. in temperature) from the air gap were water-washed, dried (140° C. in the temperature of a roller) and treated with organic solvent to be wound finally in which the fineness of the finial multi-filaments was adjusted as 1500 deniers. Each of the obtained multi-filaments were divided three parts, A, B and C, to select 100 mono filament from each of the parts, and then the average strength, elongation and denier were measured to calculate CV (%), and also the birefringence of each mono filament was measured.

Comparison 1

The multi-filaments were produced under the same condition as example 1, only except for changing the number of orifices into 450. The result showed that if the number of orifices was 450, the strength was weaker because the time was too short for the NMMO solution to be removed sufficiently owing to thickened fineness of each mono-filament during the processes of coagulation and water-washing and the physical properties was inhomogeneous.

The results are shown in Table 1 in the following.

TABLE 1

| | | Example 1 | | | | | | | | | Comparison 1 | | |
|---|---|---|---|---|---|---|---|---|---|---|---|---|---|
| | | 1-1 | | | 1-2 | | | 1-3 | | | | | |
| Kind | | A | B | C | A | B | C | A | B | C | A | B | C |
| Multi-filaments | St (g/d) | | 7.5 | | | 8.0 | | | 7.5 | | | 3.8 | |
| | B.E (%) | | 5.5 | | | 4.5 | | | 5.5 | | | 4.7 | |
| | S.B.T (s/d) | | 19 | | | 30 | | | 17 | | | 4 | |
| Mono-filament | St (g/d) | 5.0 | 5.3 | 5.9 | 6.8 | 6.0 | 6.7 | 5.0 | 5.1 | 5.3 | 2.5 | 2.7 | 2.8 |
| | St CV (%) | 7.3 | 6.6 | 7.0 | 7.7 | 7.4 | 6.4 | 7.0 | 7.0 | 6.5 | 10.3 | 10.8 | 9.3 |
| | B.E (%) | 12.0 | 12.9 | 12.1 | 11.3 | 11.1 | 10.9 | 12.3 | 12.4 | 12.8 | 11.2 | 11.7 | 11.5 |
| | B.E CV (%) | 5.4 | 5.7 | 6.4 | 6.4 | 6.9 | 7.2 | 5.5 | 4.9 | 5.7 | 9.4 | 9.8 | 10.4 |
| | De | 1.82 | 1.73 | 1.71 | 1.71 | 1.79 | 1.90 | 1.67 | 1.73 | 1.81 | 2.31 | 2.43 | 2.27 |
| | De CV (%) | 9.8 | 8.7 | 8.8 | 8.3 | 8.1 | 9.2 | 7.9 | 8.8 | 7.3 | 11.3 | 12.5 | 13.5 |
| | Bi | 0.0449 | 0.0443 | 0.0442 | 0.0443 | 0.0447 | 0.0445 | 0.0442 | 0.0442 | 0.0441 | 0.0390 | 0.0440 | 0.0441 |

Note)
St, B.E and S.B.T represent Strength (g/d), Breaking Elongation (%) and Specific Breaking Time (sec/den), respectively. And De and Bi represent Denier and Birefringence, respectively.

EXAMPLE 2

Three kinds of multi-filament were produced under the same condition as example 1, but the nozzle for spinning has 1000 orifices with 150 μm in diameter of each orifice, and three distributing plates having 100 holes (example 2-1), 200(example 2-2) and 350 (example 2-3) respectively, were used for producing three kinds of multi-filaments.

Comparison 2

Under the same condition as example 2, spinning was tried on using two kinds of distributing plate having 45 holes and 400 holes, but in case of the distributing plate having 45 holes, spinning was impossible because the spinning solution was not discharged owing to the decrease of the solution pressure within the spinning nozzle caused by partially concentrating on some portion of the spinning nozzle. In case of the distributing plate having 400 holes, some filaments was broken within the air gap, but some filaments could be obtained and the physical properties of them were measured.

The result is shown together with that of example 2 in table 2 in the following.

TABLE 2

| | | Example 2 | | | | | | | | | | | |
|---|---|---|---|---|---|---|---|---|---|---|---|---|---|
| | | 2-1 | | | 2-2 | | | 2-3 | | | Comparison 2 | | |
| Kind | | A | B | C | A | B | C | A | B | C | A | B | C |
| Multi-filaments | St (g/d) | | 7.8 | | | 8.2 | | | 6.7 | | | 5.4 | |
| | B.E (%) | | 5.3 | | | 6.4 | | | 5.7 | | | 4.2 | |
| | S.B.T | | 22 | | | 30 | | | 9 | | | 6 | |
| Mono-filament | St (g/d) | 5.7 | 5.3 | 6.1 | 6.4 | 6.2 | 6.7 | 4.8 | 4.3 | 4.4 | 3.2 | 3.1 | 3.8 |
| | St CV (%) | 8.4 | 8.3 | 8.9 | 7.5 | 6.4 | 7.1 | 9.3 | 8.4 | 8.8 | 11.0 | 13.7 | 12.1 |
| | B.E (%) | 12.3 | 12.8 | 12.9 | 13.4 | 13.0 | 13.1 | 12.2 | 12.9 | 12.4 | 11.3 | 11.8 | 11.4 |
| | B.E CV (%) | 8.3 | 8.8 | 8.4 | 6.4 | 6.5 | 7.2 | 7.4 | 8.7 | 8.3 | 12.4 | 11.8 | 11.7 |
| | De | 1.84 | 1.91 | 1.79 | 1.79 | 1.83 | 1.87 | 1.84 | 1.75 | 1.77 | 1.41 | 1.33 | 1.29 |
| | De CV (%) | 9.8 | 9.7 | 8.6 | 8.4 | 8.0 | 9.1 | 9.3 | 8.4 | 8.3 | 13.3 | 14.1 | 15.4 |
| | Bi | 0.0443 | 0.0441 | 0.0441 | 0.0449 | 0.0447 | 0.0443 | 0.0441 | 0.0442 | 0.0442 | 0.0341 | 0.0331 | 0.0393 |

Note)

St, B.E and S.B.T represent Strength (g/d), Breaking Elongation (%) and Specific Breaking Time (sec/den), respectively. And De and Bi represent Denier and Birefringence, respectively.

EXAMPLE 3

The filaments were produced under the same condition as example 1, except for the following:

150 μm in diameter of orifice; 1.0 mm in space between orifices; 1100 in the number of orifices; and the temperature and relative humidity within air gap were changed as in table 3.

Comparison 3

The filaments were produced under the same condition as example 3, except for the following:

The temperature and relative humidity within the air gap were changed into 35° C./30RH % and 20° C./65RH %, respectively. In the condition of 35° C./30RH % the filament was not cooled, resulting in being broken within the air gap.

The results are shown in Table 3 in the following.

TABLE 3

| | | Example 3 | | | | | | | | | | | |
|---|---|---|---|---|---|---|---|---|---|---|---|---|---|
| | A.G. T/ | 3-1 10° C./40 RH % | | | 3-2 20° C./55 RH % | | | 3-3 25° C./20 RH % | | | Comparison 3 20° C./65 RH % | | |
| Kind | H. RH | A | B | C | A | B | C | A | B | C | A | B | C |
| Multi-filaments | St (g/d) | | 8.3 | | | 5.1 | | | 8.7 | | | 3.9 | |
| | B.E (%) | | 4.7 | | | 6.9 | | | 5.0 | | | 7.1 | |
| | S.B.T | | 29 | | | 5 | | | 30 | | | 3 | |
| Mono-filament | St (g/d) | 6.9 | 6.8 | 6.7 | 3.5 | 3.1 | 3.7 | 6.9 | 7.1 | 7.0 | 2.1 | 2.8 | 2.7 |
| | St CV (%) | 7.4 | 7.1 | 6.3 | 7.3 | 6.9 | 6.9 | 6.3 | 6.4 | 7.0 | 10.3 | 11.1 | 10.8 |
| | B.E (%) | 11.3 | 11.4 | 11.7 | 13.4 | 13.1 | 13.4 | 12.0 | 12.4 | 12.8 | 14.2 | 14.3 | 13.8 |
| | B.E CV (%) | 7.4 | 7.2 | 7.0 | 6.8 | 7.3 | 7.1 | 7.2 | 7.1 | 6.4 | 10.7 | 9.7 | 11.0 |
| | De | 1.69 | 1.70 | 1.80 | 1.70 | 1.83 | 1.81 | 1.66 | 1.69 | 1.72 | 1.69 | 2.04 | 1.91 |
| | De CV (%) | 8.4 | 8.4 | 9.0 | 7.3 | 7.2 | 7.5 | 6.9 | 7.0 | 6.8 | 14.3 | 10.2 | 12.3 |
| | Bi | 0.0442 | 0.0452 | 0.0453 | 0.0413 | 0.0421 | 0.0423 | 0.0443 | 0.0443 | 0.042 | 0.0350 | 0.0348 | 0.0410 |

Note)

A.G..T/H. RH represents Air Gap Temperature (° C.)/Humidity. RH (%). St, B.E and S.B.T represent Strength (g/d), Breaking Elongation (%) and Specific Breaking Time (sec/den), respectively. And De and Bi represent Denier and Birefringence, respectively.

EXAMPLE 4

The cellulose fiber was produced under the same condition as example 1, except for changing the degree of cellulose sheet polymerization and concentration of cellulose solution into DP 1500 (Buckeye V5S) and 10%, respectively. The solution was spun using a spinning nozzle with 1000 orifices in which the diameter of each orifice was 250 μm and the spaces between orifices was 2.0 mm, and the final denier of the cellulose multi-filaments were adjusted as 2000. The temperature of the coagulating bath was adjusted as 5° C., 15° C. and 25° C. to produce the filaments.

Comparison 4

The multi-filaments were produced under the same condition as example 4, except for the temperature of the coagulation bath of 40° C. In case of the bath of 40° C., the NMMO was escaped rapidly from the coagulated filaments to generate voids, resulting in the degradation of the physical properties.

The results are shown in Table 4 in the following.

TABLE 4

| | | Example 4 | | | | | | | | | | | |
|---|---|---|---|---|---|---|---|---|---|---|---|---|---|
| | | 4-1 5° C. | | | 4-2 15° C. | | | 4-3 25° C. | | | Comparison 4 40° C. | | |
| | T.C.B | A | B | C | A | B | C | A | B | C | A | B | C |
| Multi-filaments | St (g/d) | | 7.8 | | | 7.3 | | | 6.5 | | | 3.3 | |
| | B.E (%) | | 4.1 | | | 4.7 | | | 6.2 | | | 7.1 | |
| | S.B.T | | 25 | | | 17 | | | 8 | | | 2 | |
| Mono-filament | St (g/d) | 5.7 | 5.8 | 5.6 | 5.3 | 5.7 | 5.8 | 4.1 | 4.5 | 4.9 | 2.1 | 3.0 | 2.7 |
| | St CV (%) | 7.0 | 7.0 | 7.3 | 7.1 | 6.9 | 6.9 | 7.4 | 7.8 | 7.9 | 9.3 | 9.1 | 9.8 |
| | B.E (%) | 11.3 | 11.4 | 10.7 | 10.4 | 11.1 | 11.2 | 13.1 | 13.0 | 13.0 | 14.2 | 14.3 | 11.8 |
| | B.E CV (%) | 7.0 | 7.1 | 6.3 | 6.5 | 7.1 | 7.3 | 7.1 | 7.0 | 6.9 | 9.1 | 9.4 | 10.0 |
| | De | 2.35 | 2.41 | 2.29 | 2.33 | 2.51 | 2.41 | 2.22 | 2.31 | 2.30 | 2.36 | 2.24 | 2.17 |
| | De CV (%) | 8.0 | 8.1 | 7.8 | 8.4 | 7.8 | 7.9 | 8.0 | 7.9 | 7.4 | 6.3 | 8.2 | 10.3 |
| | Bi | 0.0443 | 0.0441 | 0.0433 | 0.0442 | 0.0442 | 0.0431 | 0.0431 | 0.0433 | 0.0431 | 0.0317 | 0.0341 | 0.0381 |

Note)

T.C.B represents the Temperature of the Coagulating Bath. St, B.E and S.B.T represent Strength (g/d), Breaking Elongation (%) and Specific Breaking Time (sec/den), respectively. And De and Bi represent Denier and Birefringence, respectively.

EXAMPLE 5

The cellulose solution was produced under the same condition as example 1, except for changing the degree of cellulose sheet polymerization and the concentration of the solution into DP 850 (Buckeye V60) and 14%, respectively. The solution was spun through the spinning nozzle with 1000 orifices in which the diameter of each orifice was 250 μm and the spaces between the orifices was 2.0 mm, and the final denier of the cellulose multi-filaments was adjusted 2000. The temperature of the drying rollers were adjusted as 100° C., 130° C. and 160° C. to produce the filaments.

Comparison 5

The filaments were produced under the same condition as example 5, except for the 75° C. in temperature of the drying roller. In case of 75° C., drying was performed incompletely, resulting in the degradation of the physical properties.

The results are shown in Table 5 in the following.

INDUSTRIAL APPLICABILITY

The cellulose fiber according to the present invention consists of 500 to 2000 filaments, and is characterized in that the strength and breaking elongation of the filaments are 4 to 9 g/d and 4 to 15%, respectively and the physical properties are homogeneous. Therefore, the cellulose filaments can be used as industrial materials, in particular tire-cord requiring the high strength and homogeneous properties. More specifically, that each mono-filament selected 100 strands from every three part divided from multi-filaments have properties as following: (a) 3 to 9 g/d in average strength, 7 to 15% in average breaking elongation and 0.035 to 0.055 in by birefringence, (b) the differences of the above three parts are below 1.0 g/d in average strength, 1.5% in breaking elongation and 0.7 denier in denier, (c) the CV (%)(coefficient of variation) of the above three parts are below 10%, and (d) the birefringence differences of the above three parts are below 0.004.

TABLE 5

| | | Example 5 | | | | | | | | | | | |
|---|---|---|---|---|---|---|---|---|---|---|---|---|---|
| | | 5-1 100° C. | | | 5-2 130° C. | | | 5-3 160° C. | | | Comparison 5 75° C. | | |
| | T.R | A | B | C | A | B | C | A | B | C | A | B | C |
| Multi-filaments | St (g/d) | | 5.8 | | | 6.9 | | | 8.3 | | | 3.3 | |
| | B.E (%) | | 10.9 | | | 6.4 | | | 4.1 | | | 7.1 | |
| | S.B.T | | 6 | | | 9 | | | 30 | | | 4 | |
| Mono-filament | St (g/d) | 3.7 | 3.8 | 3.6 | 4.7 | 4.7 | 4.8 | 6.1 | 6.7 | 6.8 | 4.1 | 3.0 | 4.7 |
| | St CV (%) | 9.1 | 9.4 | 9.7 | 7.7 | 7.8 | 7.3 | 6.3 | 6.4 | 5.9 | 10.3 | 14.1 | 13.8 |
| | B.E (%) | 15.3 | 15.4 | 15.7 | 13.4 | 13.1 | 12.8 | 11.1 | 11.0 | 10.7 | 14.0 | 15.3 | 14.8 |
| | B.E CV (%) | 7.4 | 7.7 | 7.4 | 6.8 | 7.2 | 7.7 | 6.3 | 5.3 | 6.4 | 8.1 | 13.4 | 11.9 |
| | De | 2.30 | 2.31 | 2.27 | 2.18 | 2.41 | 2.39 | 2.32 | 2.24 | 2.21 | 2.31 | 2.14 | 2.29 |
| | De CV (%) | 7.8 | 7.3 | 7.4 | 7.4 | 7.1 | 7.3 | 7.8 | 6.7 | 7.4 | 8.3 | 9.2 | 9.3 |
| | Bi | 0.0432 | 0.0398 | 0.0410 | 0.0420 | 0.0420 | 0.0412 | 0.0431 | 0.0423 | 0.0412 | 0.0360 | 0.0347 | 0.0400 |

Note)

T.R represents the Temperature of the drying Roller. St, B.E and S.B.T represent Strength (g/d), Breaking Elongation (%) and Specific Breaking Time (sec/den), respectively. And De and Bi represent Denier and Birefringence, respectively.

The invention claimed is:

1. Cellulose multi-filament yarn produced by a method comprising the steps of:

(a) preparing a cellulose solution by swelling and homogenizing a cellulose powder into an aqueous concentrated N-methyl morpholine N-oxide (NMMO) solution;

(b) obtaining a multi-filaments by spinning said cellulose solution with a spinning nozzle having 500 to 2000 orifices and a distributing plate having 50 to 300 holes and subsequently precipitating the cellulose solution into a coagulating bath at a temperature of 0 to 35° C. through an air gap wherein the air is 5 to 30° C. in temperature and 10 to 60% in humidity is blown into the air gap at 0.5 to 10 mm/sec air speed; and (c) water-washing, drying with a drying roller maintained at a temperature of 80 to 170° C., treating the multi-filaments with a finishing oil and winding said multi-filaments, wherein the multi-filament yarn is characterized by the following physical properties:

700 to 3000 in denier of original strands;

4 to 9 g/d and 4 to 15% in strength and breaking elongation of the multi-filaments, respectively;

a specific breaking time of 3 to 33 sec/denier;

and when said multi-filaments are divided into three parts and 100 mono-filaments selected from each part of said three parts have following physical properties:

3 to 9 g/d in strength, 7 to 15% in breaking elongation and 0.035 and 0.055 birefringence, respectively;

the differences of average strength, average breaking elongation and average denier are less than 1.0 g/d, 1.5% and 0.7 denier, respectively;

CV (coefficient of variation) of average strength, average breaking elongation and denier of said three parts less an 10%; and the differences of average birefringence of said three parts are less than 0.004.

2. A tire cord comprising the cellulose fiber according to claim 1.

* * * * *